US005784919A

United States Patent [19]

Mattsson

[11] Patent Number: 5,784,919

[45] Date of Patent: Jul. 28, 1998

[54] FOLDING UNIT

[75] Inventor: Mikael Mattsson, Mörrum, Sweden

[73] Assignee: AB Volvo, Gothenburg, Sweden

[21] Appl. No.: 737,127

[22] PCT Filed: May 23, 1995

[86] PCT No.: PCT/SE95/00579

§ 371 Date: Nov. 15, 1996

§ 102(e) Date: Nov. 15, 1996

[87] PCT Pub. No.: WO95/32820

PCT Pub. Date: Dec. 7, 1995

[30] Foreign Application Priority Data

May 27, 1994 [SE] Sweden ..... 9401833

[51] Int. Cl.[6] ..... B21J 9/18

[52] U.S. Cl. ..... 72/450; 72/314; 29/243.58; 100/271; 100/280

[58] Field of Search ..... 72/450, 451, 314, 72/315, 380, 381; 29/243.58; 100/271, 280

[56] References Cited

FOREIGN PATENT DOCUMENTS

WO 89/09101 10/1989 WIPO .

*Primary Examiner*—David Jones
*Attorney, Agent, or Firm*—Young & Thompson

[57] ABSTRACT

A corner bending unit (2) for achieving a reciprocating movement in a tool holder (14) for a bending tool (12), the tool holder being articulated to a foundation (4) via parallel links (16, 18). The corner bending unit (2) has a pneumatic cylinder (38) with a piston rod (36) which is pivotally (34) joined to a triangle link (30), which is in turn pivotally joined (32) to one end of a link (28), the other end of which being joined to a pivot point (22) on the tool holder. The triangle link is pivotally carried in the foundation (4) about a pivot point (24) and forms, together with the link (28), a knee-joint mechanism (28, 30), which, under the influence of the cylinder (38) piston rod (36), can be moved from the bent-out position shown to a completely extended position, the tool holder (14) being movable between a starting position and a work position. The pivot point (22) is common to parallel link (16) and the link (28), and pivot point (24) is common to parallel link (18) and the triangle link (30).

6 Claims, 2 Drawing Sheets

FOLDING UNIT

FIELD OF THE INVENTION

The invention relates to a prebending unit, especially a corner bending unit, for providing a reciprocating movement or a tool holder pivotally joined to a foundation, said tool holder being supported in such a manner as to be displaceable by means of an operating device coupled to a drive device along a predetermined path of movement between a starting position and a work position.

BACKGROUND OF THE INVENTION

Bending units of the above mentioned type are well known in a number of different designs. They are used to prebend a margin flange of one sheet metal panel around the edge of another panel, especially at the corner portions of the panels, with final bending taking place separately to achieve a clinchor welt joining the two panels to each other. Operations of this type are for example common in the auto industry in the manufacture of doors, engine hoods and similar body parts. Conventionally, a bending unit of the type described here is driven by means of an hydraulic cylinder which actuates a pivotally mounted tool holder. Extension and retraction of the piston rod of the hydraulic cylinder actuates the tool holder to impart a desired movement to the tool and produce the required force so that the tool can carry out the desired bending operation.

This arrangement makes it possible to achieve a pressing force of about 10,000–12,000N, which is quite sufficient for the purpose. A disadvantage of an hydraulically driven cylinder is that there is always a certain amount of leakage of hydraulic fluid, thus soiling the components and increasing the risk of accidents due to fluid spillage on the floor.

The purpose of the present invention is therefore to achieve a prebending unit of the type described by way of introduction, which is cleaner and which generates the required pressing force by converting distance into force without the above mentioned disadvantages, and which is of simple construction and reliable function. This is achieved according to the invention in a prebending unit of the type described by way of introduction, which is characterized in that the operating device comprises an operating means and parallel links joined to a knee-joint mechanism, which has a link, one end of which is joined to a pivot point located on the tool holder, said pivot point being common to the link and the parallel link, the other end of said link being joined to a first pivot point on a triangle link, that a second pivot point on the triangle link is joined to a pivot point which is fixed in the foundation and which is common to the triangle link and the parallel link, that the operating means is joined to a third pivot point on the triangle link and that the knee-joint mechanism actuated by the operating means can be moved from a bent-out position where the tool holder is in its starting position, to a completely extended position where the tool holder is in its work position and then be returned to the bent-out position.

Advantageous embodiments of the device according to the invention are disclosed in the subclaims.

BRIEF DESCRIPTION OF THE DRAWINGS

The invention will be described in more detail below with reference to the accompanying schematic drawings, which show one embodiment of the invention and in which.

DETAILED DESCRIPTION OF THE INVENTION

Figure 1:
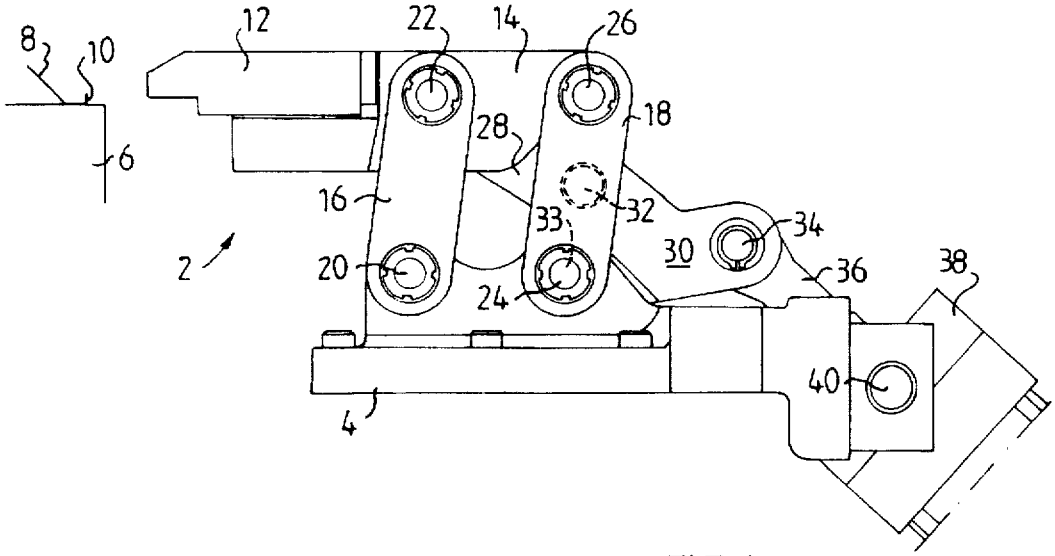
FIG. 1 is a sideview or a prebending unit according to the invention shown in its starting position.

The corner bending unit 2 shown in the drawings is constructed of a foundation 4 which is fixed to a frame (not shown), which supports a counter surface 6 for a workpiece 8 with a margin flange 10, which is to be bent in towards the major portion of the workpiece 8 with the aid of a bending tool 12.

The tool 12 is supported by a tool holder 14, which in, turn is supported by a linkage system with two links 16 and 18. The link 16 is articulated at pivot points 20 and 22, respectively, to the foundation 4 and the tool holder 14, respectively, and the link 18 is articulated at pivot points 24 and 26, respectively, to the foundation 4 and the tool holder 14, respectively. The pivot points 20–26 are in practice pins, about which the components pivot.

Figure 2:
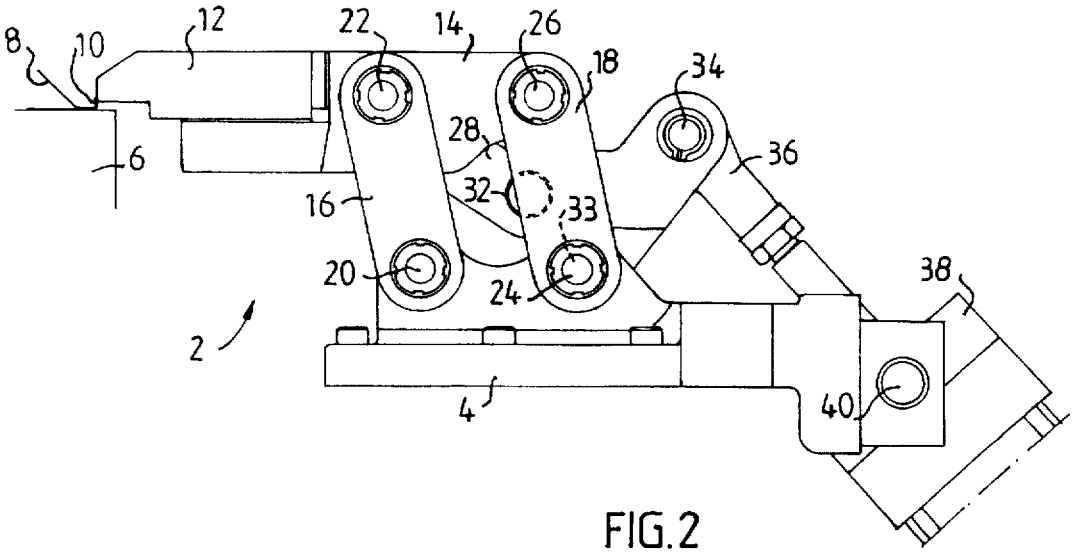
FIG. 2 is a sideview corresponding to FIG. 1 but with the prebending unit shown when the tool has just reached the workpiece.
Figure 3:
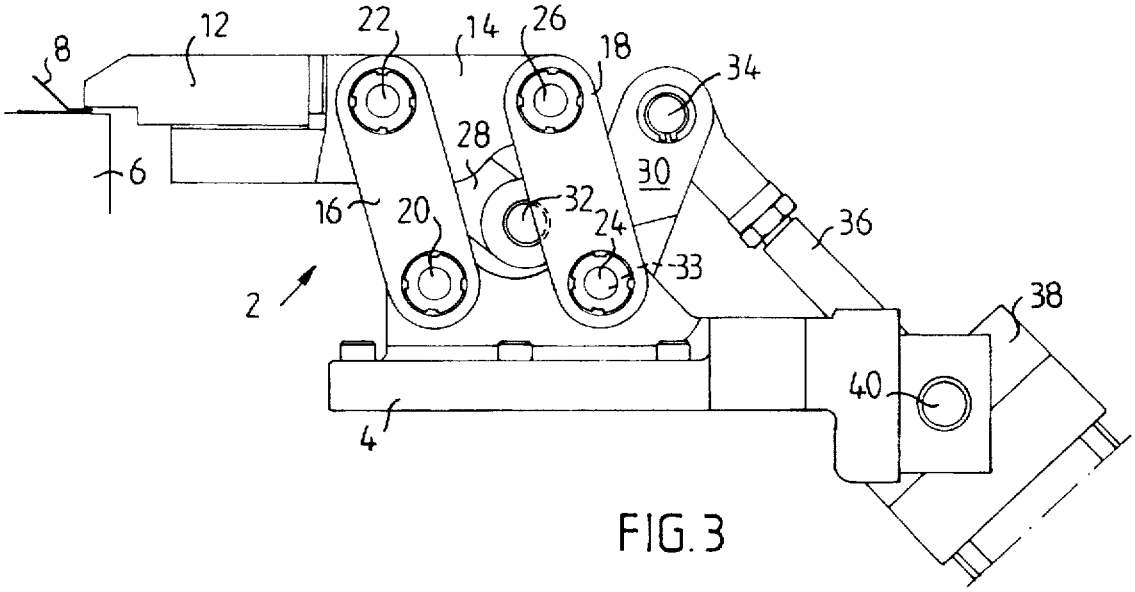
FIG. 3 is a sideview corresponding to FIG. 1 but with the prebending unit shown in a work position.
Figure 4:
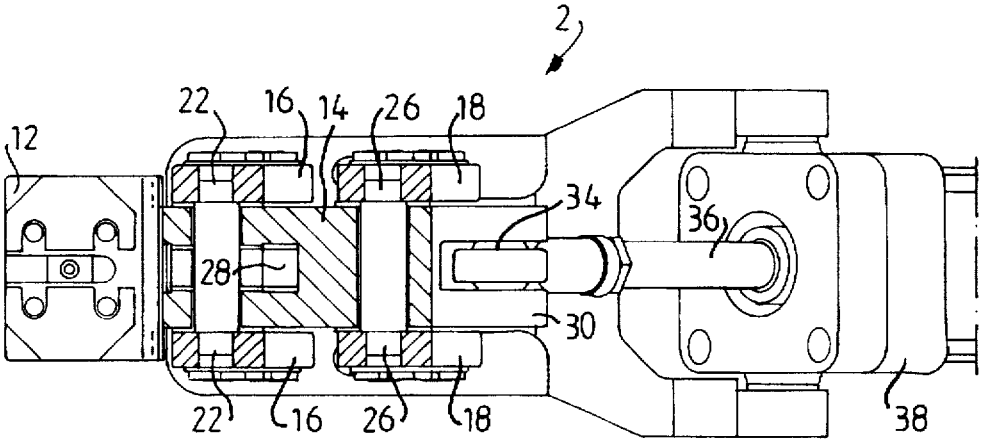
FIG. 4 is a partially sectioned view of the prebending unit according to FIG. 1 as seen from above.

The links 16 and 18 form together with the foundation 4 and the tool holder 14 a parallelogram linkage system, which makes it possible to displace the tool holder 14 and the tool 12 relative to the foundation 4 and the counter-surface 6 in such a manner that the tool 12 can be moved from the starting position shown in FIG. 1 via the intermediate position shown in FIG. 2 to the work position shown in FIG. 3.

As can be seen in the drawings, the links 16 and 18 are of equal length, which means that the tool 12 will always be oriented parallel to the workkpiece and will follow an arcuate path, from the starting position to the work position, and vice versa. This movement is controlled by a knee-joint mechanism 28,30 consisting of a link 28 and a triangle link 30, said link 28 being joined at its one end to the pivot point 22 on the tool holder 14 and being joined at its other end to a first pivot point 32 on the triangle link 30. The triangle link 30 has a second pivot point 33 which is joined to the fixed pivot point 24 in the foundation, and the triangle link has a third pivot point 34 which is joined to a piston rod 36 of a pneumatic cylinder 38, which in turn is joined to a pivot point 40 on the foundation 4. The pivot points 32, 34 and 40 are, in this case as well, in practice pins about which the components can pivot.

The three pivot points 32, 33 and 34 of the triangle link 30 are located each in a separate corner of a triangle, the size of which are the connecting lines between the pivot points. The side between the pivot points 32 and 33 is shorter than the side between the pivot points 33 and 34 and is preferably half as long as that side. The side 32,33 forms a first linkage arm preferably forming an angle of 70° with the side 33,34 which forms a second linkage arm.

For driving the tool 12 and the tool holder 14 along the predetermined path of movement, the pneumatic cylinder 38 is coupled via control valves (not shown) to a source of compressed air (not shown) . The function of the above described device is as follows.

FIG. 1 shows the corner bending unit in its starting position with the tool holder 14 and the tool 12 at their greatest distance from the workpiece on the counter-surface 6. In operation or the bending unit, the tool holder 14 with the bending tool 12 is displaced by means of the cylinder 38 piston rod 36 which, Asa the pivot point 34, when the piston rod is pressed out of the cylinder 38, pivots the triangle link 30 about the second pivot point 24 in such a manner that the first pivot point 32 of the triangle link is also pivoted about the pivot point 24 towards the pivot point 20 in the foundation, as can be seen in FIG. 2. By virtue of the fact that the first linkage arm 32,33 is shorter than the second linkage arm 33,34, the triangle link 30 acts with force-increasing mechanical advantage, due to the lever effect of the linkage arms. In this position, the tool 12 abuts the margin flange 10, which is to be bent over, and the knee-joint mechanism 28,30 is almost straightened out, but the pivot points 22, 32 and 24 are still not in alignment with each other and the second linkage arm 33,34 has just passed a 90° position relative lo the centerline of the piston rod 36.

In the position shown in FIG. 2, there is a decrease in the hitherto predominant effect of the second linkage arm 33,34 on the movement of the tool holder 14 and thus the tool 12, while the knee-joint mechanism 28,30, comprising the first linkage arm 32,33, gradually assumes a predominant effect on the transmission of movement and force from the foundation 4 to the tool holder 14 and the tool 12.

When the piston rod 36 is extended further out of the cylinder 38, the triangle link 30 pivots further about the pivot point 24 to the position shown in FIG. 3, where the piston rod is in its maximally extended position, in which the knee-joint mechanism 28, 30 is completely extended, i.e. the pivot points 22, 32 and 24 are in a straight line with each other. When the knee-joint mechanism 28, 30 moves from the almost extended position shown in FIG. 2 to the completely extended position shown in FIG. 3, a very large Force can be transmitted from the foundation 4 to the tool holder 14 and the tool 12, and this force is used to carry out the required bending work.

After a finished work stroke, the piston rod 36 is pulled into the cylinder 38 by means of operating the control valves (not show), whereby the tool holder 14 and the tool 12 return to the starting position shown in FIG. 1 and the bending unit 2 is ready for a new cycle.

By converting length of movement into force by the knee-joint mechanism 28,30, it is possible to use an operating means in the form of a pneumatic cylinder which, with practically usable dimensions, is capable of generating a maximum pressing force of about 150 N and still achieve the required pressing force of 10,000–12,000N when the tool 12 meets the flange 10. By virtue of the fact that the knee-joint mechanism 28,30 is built-in in the linkage arm system 14, 22, 20, 4, 24 and 26, a compact bending unit, requiring less space than conventional systems using hydraulic cylinders, is achieved.

The knee-joint mechanism 28, 30 is arranged between the doubled links 16 and 18 in such a manner that they act, on the one hand, centrally on the shaft through the Divot point 22 on the tool holder 14 and, on the other hand, on the shaft through the pivot point 24 in the foundation 4.

Finally, it is pointed out that the device according to FIGS. 1–4 is arranged symmetrically with the tool holder 14, and the knee-joint 28,30, the foundation 4, the piston rod 36 and the cylinder 38 are arranged centrally. The parallelogram linkage system is doubled, i.e. identical linkage systems are arranged on either side of the foundation 4 and the tool holder 14. By virtue of the fact that the motion mechanism which controls the movements of the tool holder 14 and thus the tool 12 is doubled, oblique loads are avoided at the same time as a more stable system is achieved.

The invention is of course not limited to the embodiment described above. Rather, changes can be made within the scope of the following claims. It is thus possible to remove one link in the parallelogram linkage system with two parallel links and make the remaining link integral with the tool holder. When the knee-joint mechanism is operated, the tool in the tool holder will then perform a rocking movement about the pivot point of the remaining link in the foundation.

What is claimed is:

1. Prebending unit for achieving a reciprocating movement comprising a tool holder pivotally joined to a foundation, said tool holder being supported by parallel links, which are journalled in pivot points on the foundation, and in pivot points on the tool holder, in such a manner as to be displaceable by an operating device coupled to a drive device, along a predetermined path of movement between a starting position and a work position, wherein the operating device includes said parallel links and operating means joined to a knee-joint mechanism, which has a link having a first end and a second end, the first end being joined to one of the pivot points located on the tool holder, said one pivot point on the tool holder being common to said link and one of the parallel links, the second end of said link being joined to a first pivot point on a triangle link; a second pivot point on the triangle link being joined to one of the pivot points which is fixed in the foundation and which is common to the triangle link and another one of the parallel links; the operating means being joined to a third pivot point on the triangle link whereby the knee-joint mechanism actuated by the operating means can be moved from a retracted position where the tool holder is in its starting position, to a completely extended position where the tool holder is in its work position, and then be returned to the retracted position.

2. Prebending unit according to claim 1, wherein the knee-joint mechanism is arranged to act centrally on a shaft through the one pivot point on the tool holder, and on a shaft through the one pivot point fixed in the foundation, by the parallel links being doubled and the knee-joint mechanism being arranged between the doubled links.

3. Prebending unit according to claim 1, wherein the operating means comprise a pressure medium cylinder articulated to the foundation and having a piston rod whose free end is joined to the third pivot point on the triangle link.

4. Prebending unit according to claim 1, wherein the parallel links are of equal length.

5. Prebending unit according to claim 1, wherein the triangle link comprises a first linkage arm arranged between the first and second pivot points of the triangle link, a second linkage arm arranged between the second and third pivot points of the triangle link, and wherein the linkage arms are of different length.

6. Prebending unit according to claim 5, wherein the first linkage arm forms an angle ranging between 60°–80° with the second linkage arm.

* * * * *